United States Patent [19]

Huhse et al.

[11] 4,032,737

[45] June 28, 1977

[54] CONTACT SYSTEM FOR HIGH-VOLTAGE POWER CIRCUIT BREAKERS

[75] Inventors: Peter Huhse; Heiner Marin; Harald Kurzmann; Marion Henry, all of Berlin, Germany

[73] Assignee: Siemens Aktiengesellschaft, Munich, Germany

[22] Filed: Sept. 19, 1974

[21] Appl. No.: 507,629

[30] Foreign Application Priority Data

Oct. 5, 1973 Germany ..... 2350702

[52] U.S. Cl. ..... 200/148 R; 200/266

[51] Int. Cl.[2] ..... H01H 33/00; H01H 1/02

[58] Field of Search ..... 200/148 R, 148 G, 266

[56] References Cited

UNITED STATES PATENTS

| | | | |
|---|---|---|---|
| 2,143,914 | 1/1939 | Hensec et al. | 200/266 |
| 2,178,508 | 10/1939 | Zickrick | 200/266 |
| 2,278,592 | 4/1942 | Sanders et al. | 200/266 |
| 2,796,495 | 6/1957 | Keitel et al. | 200/266 |
| 3,835,274 | 9/1974 | Marin | 200/148 R |

*Primary Examiner*—Robert S. Macon

*Attorney, Agent, or Firm*—Kenyon & Kenyon, Reilly, Carr & Chapin

[57] ABSTRACT

A contact system for power circuit breakers includes a nozzle body made of graphite which is pressed cold into a tube of cold-worked copper and is enclosed by the latter with a friction fit. A low-alloy copper is used as the material for the electrically conducting tube. Such a copper alloy can be made, for example, with 0.1 percent silver.

6 Claims, 1 Drawing Figure

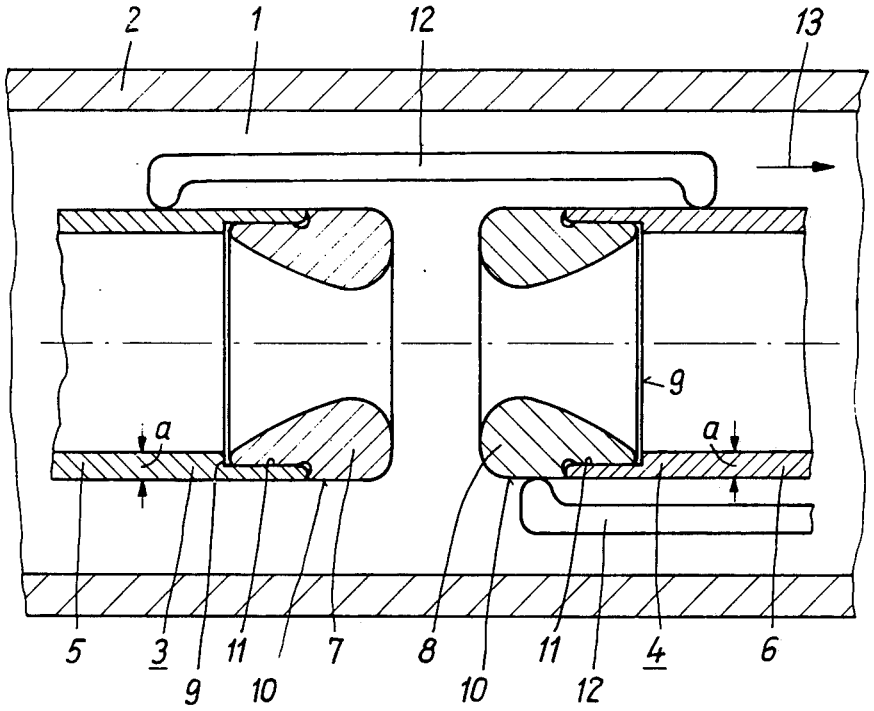
2
1
12
13
9
a
a
5
3
9
11
10
7
8
10
11
12
4
6

CONTACT SYSTEM FOR HIGH-VOLTAGE POWER CIRCUIT BREAKERS

BACKGROUND OF THE INVENTION

Deutsche Auslegeschrift No. 1,154,548 discloses an electric switch wherein an electronegative, fluorine-containing gas, particularly sulfur hexafluoride ($SF_6$) is used as the quenching and insulating medium. The known switch includes two contacts which are movable relative to each other and between which an arc is drawn when the circuit is opened. The contacts consist of carbon, preferably graphite, in order to keep the destruction of the contacts and the formation of decomposition products low during the active time of the arc. The contacts, which consist of graphite, are made solid and are inserted into cup-shaped electrodes, the wall of the cup-shaped electrodes engaging at least partially in undercuts of the contacts on the cylinder surface, so that a secure mechanical and electrical connection is obtained.

In high-voltage power circuit breakers, particularly compressed-gas breakers, it is advantageous to make the contacts hollow for the removal of the arc gases produced during the interrupting process.

U.S. Pat. No. 3,801,764 discloses an arrangement wherein the annular graphite electrode, configured for the removal of switching gases is enclosed with an annular, electrically conducting body with a friction fit, which, in turn, is connected with the corresponding contact piece in an electrically conducting manner. The intermediate body, which in this arrangement holds the electrode can be chosen so with respect to the currents and the material composition so that advantageous expansion coefficients are obtained as compared to the graphite electrode which, because of the arc, must take up high thermal stresses.

The last-mentioned arrangement requires a press fit in which the graphite nozzle as an insert is deep-cooled relative to the enclosing annular metal body while the enclosing annular body is brought to a high temperature.

It is desirable to make the contact piece supporting the graphite electrode of an electrically highly conducting material, particularly copper, in order to be able to transmit large rated currents without a significant temperature rise. However, the use of copper as the holder for graphite electrodes presents difficulties because due to the necessary excess dimensions of the friction mounting, the strength of the copper may be exceeded. Such a shrink joint is therefore not usuable for the present case.

United States patent application, Ser. No. 366,541, filed June 4, 1973 dicloses a contact system for a high-voltage circuit breaker wherein the problem of joining the materials graphite and copper securely together is solved by pressing the nozzle body consisting of graphite cold into a tube which is made of cold-worked copper so that the nozzle body is enclosed by the tube with a friction fit.

SUMMARY OF THE INVENTION

It is an object of the invention to further develop contact systems for high-voltage power circuit breakers such as compressed-gas circuit breakers and the like so that the current-carrying capacity and the mechanical load capacity of the friction-fit joint are increased.

According to the invention, the above object is realized by the improvement of using a low-alloy copper for the electrically conducting copper tube. To particular advantage, a silver-copper alloy is used having a silver content between 0.025 and 0.25 percent, and preferably 0.1 percent.

However, another possibility is for a low alloy copper in a copper-zirconium alloy wherein the zirconium portion is in the range from 0.08 to 0.3 percent.

If the conducting copper tube is to be soft or hard soldered to other switch parts in the course of the manufacturing process, a copper alloy with the mentioned low silver or zirconium content is preferred, which is deoxidized with phosphorus or other suitable agents such as lithium for example.

With the invention, the regions of the friction fit joint between the graphite body and the electrically conducting tube are mechanically more stable because the recrystallization temperature of the low-alloy copper is increased in an advantageous manner. The conductivity of the copper material is furthermore very high while at the same time the mechanical properties have been raised.

Although the invention is illustrated and described herein as a Contact System for High-Voltage Power Circuit Breakers it is nevertheless not intended to be limited to the details shown, since various modifications may be made therein within the scope and range of the claims. The invention, however, together with additional objects and advantages will be best understood from the following description and in connection with the accompanying drawings.

BRIEF DESCRIPTION OF THE DRAWING

The drawing illustrates, partially in section, the contact system according to the invention. The contact system is for an electric high-voltage power circuit breaker constructed as a compressed-gas circuit breaker. In the upper half of the drawing, the bridging contact member is shown in the closed position; whereas, in the lower half, the bridging contact member is in the open position.

DESCRIPTION OF THE PREFERRED EMBODIMENTS OF THE INVENTION

The interior of a switching chamber 2 is filled with sulfur hexafluoride as the quenching and insulation medium. The switching chamber is of tubular shape and includes two stationary, centrally arranged contact pieces 3, 4, which face each other with a spacing therebetween and are of identical construction. The contact pieces 3, 4 each include an electrically conducting tube 5, 6. At their end faces, the tubes 5 and 6 carry nozzle bodies 7 and 8, respectively, the nozzle bodies 7, 8 being made of graphite as an arc-resistant material. The two tubes 5 and 6 may consist of a silver-copper alloy with a silver content of 0.025 to 0.25 percent of a copper-zirconium alloy; preferably, the silver content is 0.1 percent. In the closed position shown above the center line, the two tubes are bridged in an electrically conducting manner by a bridging contact member 12.

If the bridging contact member 12 is moved in the direction of the arrow 13, the bridging contact element gets into the open position shown below the center line. Here, an arc is drawn between the graphite nozzle bodies 7 and 8 which is driven into the interior of the hollow, nozzle-shaped contacts 3 and 4 by a gas stream initiated in the interior 1 of the switching chamber 2 and is extinguished at the zero crossing of the alternating current.

The two contact tubes 5 and 6 are cold-worked. In the region of the end face, each has a cylindrical recess or counterbore whose radial dimension forms about half the wall thickness *a* of the tubes 3 and 4. The nozzle bodies 7 and 8 in turn have on their outer surface 10 a cylindrical step 11 which, with its cylindrical surface is intended for a friction fit with the tubes 5 and 6 respectively. The nozzle bodies 7 and 8, consisting of graphite, are passed cold into the counterbore 9 of the tubes 5 and 6, respectively, with part of the nozzle body 7, 8 protruding. During the pressing, grooves can form in the graphite body at the cylindrical surface 11, whose material appears in the form of dust, for example, and can serve as a lubricant in the pressing operation.

The configuration of the tubes 5, 6 with a counterbore 9 relieves the nozzle body 7, 8 in the fracture-prone region of the end not held and ensures higher specific pressure at the end of the nozzle body which is held because there, the recessed region of the tube is supported by the adjoining part of the tube.

The contact system according to the invention can be used, of course, also in other high-voltage switch gear provided with a gaseous insulating medium. Thus, it is, for instance, possible to equip load disconnect switches or gas-filled spark gaps of overvoltage arresters with the contact system according to the invention.

What is claimed is:

1. In a contact system for a highvoltage circuit breaker of the compressed-gas type or the like, the contact system defining a gap which is blasted with the gas to quench an arc drawn thereacross when the breaker is switched to the open position, the contact system having at least one hollow, nozzle-shaped contact piece defining one end of the gap when the breaker is switched to the open position, the contact piece including an electrically conductive tubular member made of cold work-hardened copper, the tubular member having an end portion, and a nozzle-shaped body made of graphite, the nozzleshaped body being cold press-fitted into the tubular member at the end portion thereof so as to be held in surrounding engagement thereby in a friction-tight manner wherein the improvement comprises making said tubular member of a low alloy copper having a silver content in the range of from 0.025 to 0.25 percent.

2. The improvement of claim 1, said low alloy copper including a quantity of a deoxidation agent.

3. The improvement of claim 1, said silver content being 0.1 percent.

4. The improvement of claim 3, said low alloy copper including a quantity of a deoxidation agent.

5. In a contact system for a high-voltage breaker of the compressed-gas type or the like, the contact system defining a gap which is blasted with the gas to quench an arc dawn thereacross when the breaker is switched to the open position, the contact system having at least one hollow, nozzle-shaped contact piece defining one end of the gap when the breaker is switched to the open position, the contact piece including an electrically conductive tubular member made of cold work-hardened copper, the tubular member having an end portion, and a nozzle-shaped body made of graphite, the nozzle-shaped body being cold press-fitted into the tubular member at the end portion thereof so as to be held in surrounding engagement thereby in a friction-tight manner wherein the improvement comprises making said tubular member of a low alloy copper, said low alloy copper being an alloy of copper and zirconium having a zirconium content in the range of from 0.08 to 0.3 percent.

6. The improvement of claim 2, said low alloy copper including a quantity of a deoxidation agent.

* * * * *